United States Patent [19]

Wang

[11] Patent Number: 4,956,757

[45] Date of Patent: Sep. 11, 1990

[54] LAMP DEVICE

[76] Inventor: Chern-Jen Wang, No. 199, Sec. 1, Hua Mei W. St., Taichung, Taiwan

[21] Appl. No.: 396,298

[22] Filed: Aug. 21, 1989

[51] Int. Cl.[5] ..... F21P 1/00

[52] U.S. Cl. ..... 362/252; 362/807

[58] Field of Search ..... 362/249, 252, 806, 807, 362/405, 226

[56] References Cited

U.S. PATENT DOCUMENTS

| | | | |
|---|---|---|---|
| 1,923,144 | 8/1933 | Graf | 362/252 X |
| 1,977,126 | 10/1934 | Graf | 362/252 X |
| 2,172,757 | 9/1939 | Pollock | 362/807 X |
| 4,225,901 | 9/1980 | Luce | 362/249 X |
| 4,835,748 | 5/1989 | Krause, Jr. | 362/249 |

*Primary Examiner*—Ira S. Lazarus
*Assistant Examiner*—Peggy Neils

[57] ABSTRACT

A lamp device includes a lamp-holding member having a first and a second half portion each having an annular member, with a central opening and a plurality of channel members which extend radially from the annular member. Each of the channel members of the first half portion mates with the channel member of the second half portions to define a socket for holding a lamp. A plurality of conducting members are positioned among the channel members of the lamp-holding member and are electrically connected with the lamps mounted to the lamp-holding member to form a series circuit. Two fixing seats are mounted in the lamp-holding member which are diametrically adjacent to the central openings. Each of the fixing seats has a contact member mounted therein and is electrically connected to the series circuit. An elongated insulating column has two opposed grooves formed along the length of the column. Each of the grooves has a conducting strip fixed in the bottom portion of the groove. The insulating column is passed through the central openings of the lamp-holding member with the conducting strips of the insulating column being slidably engaged with the contact members.

1 Claim, 3 Drawing Sheets

LAMP DEVICE

BACKGROUND OF THE INVENTION

This invention relates to a lamp device, and more particularly to a lamp device, a plurality of which can be connected together successively by a linear column.

My U.S. Pat. No. 4,783,726 disclosed a modular lamp device and a plurality of the same which can be interconnected successively so as to constitute a variety of assemblies. However, it was found that such a lamp assembly was not straight in appearance when said lamp devices were interconnected successively.

SUMMARY OF THE INVENTION

It is therefore a main object of this invention to provide a lamp device a plurality of which can be connected in succession to a linear column so as to enhance the aesthetic quality thereof.

Accordingly, a lamp device of the present invention includes:

a lamp holding member having two half portions thereof detachably connected with each other, each of the half portions having an annular member, with a central opening and a plurality of channel members, including a groove extending radially from a periphery thereof which mates with the channel member of another of the half portions to define a socket for holding a lamp;

a plurality of conducting members positioned among the channel members of the lamp-holding member and electrically connected with the lamps mounted to said lamp-holding member so as to form a series circuit;

at least two fixing seats mounted in the lamp-holding member which are diametrically adjacent to the central openings of said lamp-holding member, each of the fixing seats having a contact member mounted therein and being electrically connected to the series circuit; and an elongated insulating column having at least two opposed grooves formed along a length thereof, each of the grooves having a conducting strip fixed therealong, the column being adapted to be passed through the central openings of the lamp-holding member with the conducting strips thereof being slidably engaged with the contact members of said lamp-holding member. Thereby, a plurality of the lamp-holding members can be sleeved on said column and connected linearly.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
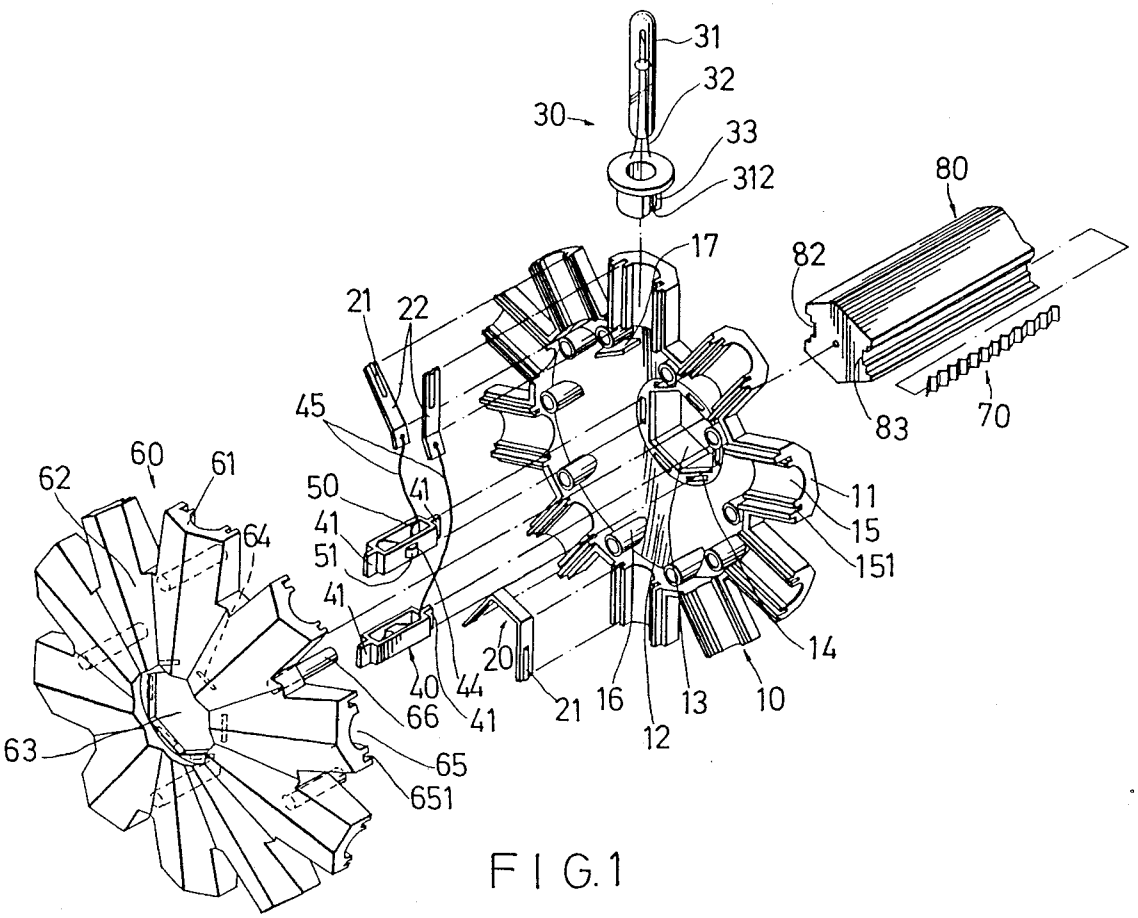
FIG. 1 is a perspective exploded view of a preferred embodiment of a lamp device of this invention.
Figure 2:
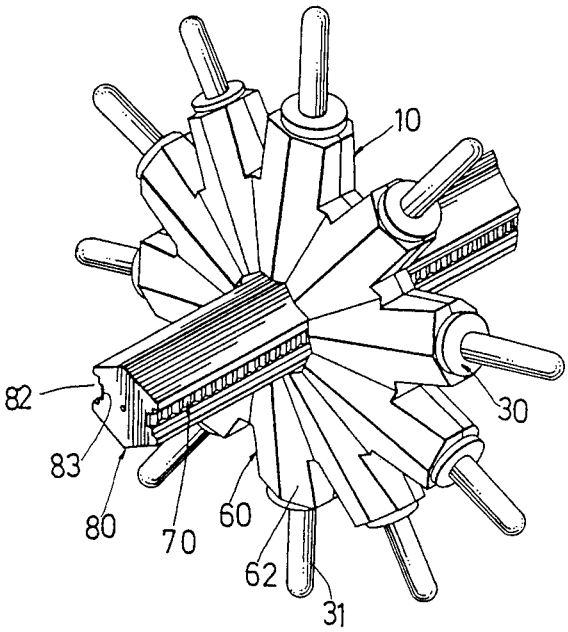
FIG. 2 is a perspective view of a preferred embodiment of a lamp device of this invention.

Referring to FIGS. 1 and 2, a preferred embodiment of a lamp device is shown. The lamp device includes a lamp-holding member formed of insulating material consisting of a first and second half portion 10, 60 which are detachably connected with each other by means of the interengagement of a plurality of corresponding hollow projections 16 provided on the inner face of the first half portion 10 and a plurality of pins 66 provided on the inner face of the second half portion 60. Said first and second half portions 10, 60 respectively have annular members 12, 62 with two hexagonal central openings 13, 63 formed therein. A plurality of channel members 11, 61 extend respectively and radially from the peripheries of the annular members 12, 62 of said first and second half portions 10, 60. Each of the channel members 11, 61 has a radial groove 15, 65 formed between two side walls thereof so as to confine a socket for receiving a lamp 30. Each of the lamps 30 comprises a bulb 31 and a lamp base 33 in which the bulb 31 is inserted. Two lamp wires 32 are passed through the bottom of the lamp base 31 and returned to rest on two projections 312, (the wire and projection on the other side of the lamp base 33 are not shown in the drawings), which are provided on opposite sides of the lamp base 33. Each of the side walls of the channel members 11, 61 has a radial receiving groove 151, 651 formed therein so that a plurality of generally U-shaped conducting members 20 can be positioned therein when said two half portions 10, 60 are connected with each other. One of said conducting members 20 is formed of a pair of conducting blades 22 which are received in the radial receiving grooves 151, 651 and supported by a insulating supporting plate 17 provided on the inner face of said first half portion 10. The lamps 30 are inserted into the sockets of the lamp-holding member so that the lamp wires 32 of each of the lamps 30 are respectively clamped by two adjacent conducting members 20 with each of the lamp wires 32 being snugly clamped between the projection 312 of the lamp base 33 and the ridge 21 formed on each blade portion of the conducting members 20. Thereby, a series circuit is provided in the lamp-holding member.

Two rectangular fixing seats 40 formed of insulating material which are adjacent to the central openings 13, 63 of said first and second half portions 10, 60, are diametrically mounted on the lamp-holding member. Each of the fixing seats 40 has two opposed protrusions 41 respectively inserted into two holes respectively formed in the inner faces of said first and second half portions 10, 60, near the peripheries of the central openings 13, 63 of the same. Two metal spring contacts 50 are respectively positioned in the fixing seats 40. Each of said metal spring contacts 50 has a contact portion 51 which protrudes from an aperture 44 formed on the fixing seat 40 and faces another contact portion 51 of another fixing seat 40. Two wires 45 are respectively connected between the metal spring contacts 50 and said pair of conducting blades 22.

An elongated insulating column 80, which is hexagonal in cross section, has two opposed U-shaped grooves 82 formed along the length thereof. Each of the U-shaped grooves 82 of the column 80 has a channel 83, which is trapezoidal in cross section, formed along the bottom portion thereof for positioning a corrugated copper strip 70 received therein. The column 80 is passed through the central openings 13, 63 of the lamp-holding member with the copper strips 70 being individually and slidably engaged with the contact portions 51 of the metal spring contacts 50 and, thereby, said series circuit.

Figure 3:
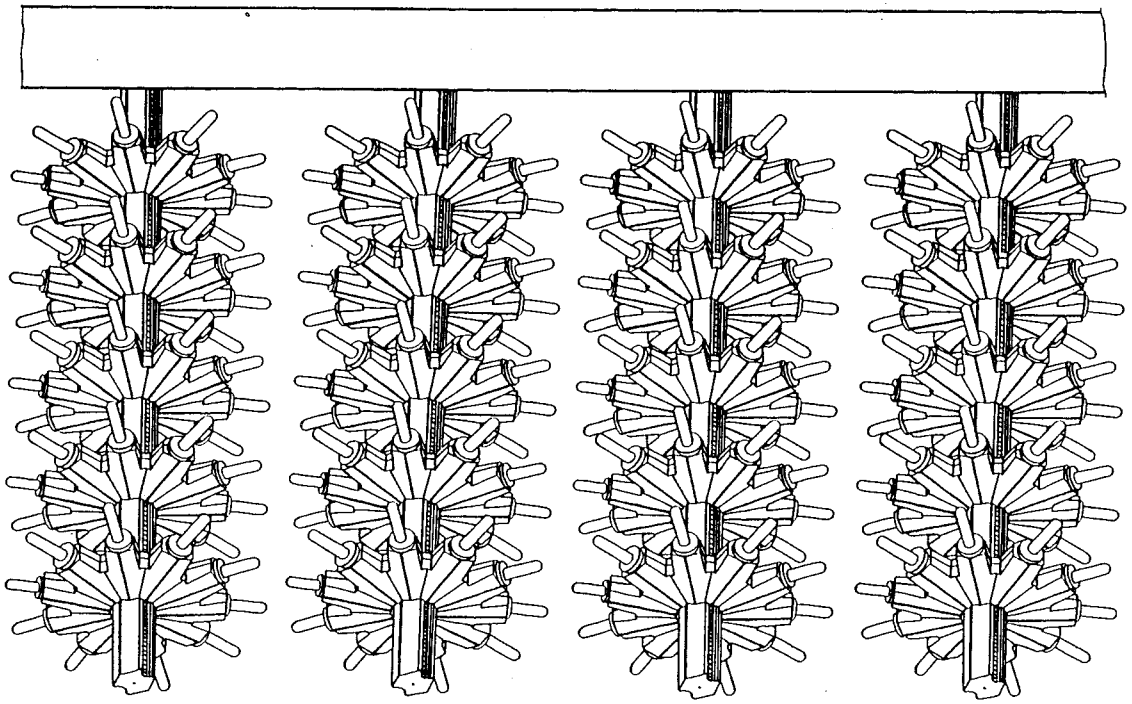
FIG. 3 is a schematic view showing a plurality of the lamp devices of this invention which are linearly connected in succession.

Referring to FIG. 3, a plurality of lamp-holding members can be sleeved on the column 80 in accordance with the present invention so as to be linearly connected in succession, therefore enhancing the esthetic quality thereof.

With this invention thus explained, it is apparent that numerous modifications and variations can be made without departing from the scope and spirit of this invention. It is therefore intended that this invention be limited only as indicated in the appended claims.

I claim:

1. A lamp device comprising: a plurality of lamps each of which has a lamp base provided with two electric contacts;

a lamp-holding member having two half portions detachably connected with each other, each of said half portions having an annular member with a central opening and a plurality of channel members with a groove extending radially from a periphery thereof which mates with said channel member of another said half portions to define a socket for holding one of said lamp bases of said lamps;

a plurality of conducting members positioned among said channel members of said lamp-holding member and connected with said contacts of said lamps so as to form a series circuit;

at least two fixing seats mounted diametrically opposite in said lamp-holding member which are adjacent to central openings, each of said fixing seats having a contact member mounted therein and being electrically connected to said series circuit;

an elongated insulating column having at least two opposed grooves formed along a length thereof, each of said grooves having a conducting strip fixed therealong, said column being adapted to be passed through said central openings of said lamp-holding member with said conducting strips thereof being slidably engaged with said contact members;

whereby said column can pass through a plurality of said lamp-holding members to form a linear lamp assembly; and wherein each of said grooves of said column is generally U-shaped in cross section with a bottom portion and has a channel which is trapezoidal in cross section formed inwardly along said bottom portion of said groove for receiving one of said conducting strips.

* * * * *